United States Patent [19]

Nahum

[11] 4,371,996

[45] Feb. 8, 1983

[54] ARTICULATED BED

[76] Inventor: Sylvain Nahum, 16 avenue Dumas, 1206 Geneva, Switzerland

[21] Appl. No.: 229,590

[22] PCT Filed: Jan. 31, 1980

[86] PCT No.: PCT/CH80/00010

§ 371 Date: Jan. 2, 1981

§ 102(e) Date: Jan. 2, 1981

[87] PCT Pub. No.: WO80/01979

PCT Pub. Date: Oct. 2, 1980

[30] Foreign Application Priority Data

Aug. 11, 1979 [CH] Switzerland ..... 7332/79

[51] Int. Cl.[3] ..... A61G 7/00

[52] U.S. Cl. ..... 5/69; 5/108

[58] Field of Search ..... 5/60–62, 5/66–69, 108, 109; 297/316, 318, 319, 329

[56] References Cited

U.S. PATENT DOCUMENTS 1,529,699 3/1925 Hawk ..... 5/66

1,740,906 12/1919 Rothauszky ..... 5/66

FOREIGN PATENT DOCUMENTS 565835 12/1932 Fed. Rep. of Germany .

597799 9/1978 Switzerland ..... 5/66

525036 8/1940 United Kingdom ..... 297/329

*Primary Examiner*—Roy D. Frazier

*Assistant Examiner*—Michael F. Trettel

*Attorney, Agent, or Firm*—Robert E. Burns; Emmanuel J. Lobato; Bruce L. Adams

[57] ABSTRACT

An articulated bed having a tubular frame, a mattress-holder made up in three parts; a back-rest, a seat-rest and a leg-rest; an arcuate cradle welded to the frame; a carrier capable of rolling on the cradle and an air compressed jack acting on the carrier. Under the combined action of the weight of the carrier and of the jack, the mattress-holder is practically in a state of stable equilibrium in any relative position of the back-rest and of the seat-rest.

9 Claims, 3 Drawing Figures

ARTICULATED BED

The present invention relates to a bed of which the mattress-holder is made up of at least a seat-rest and a back-rest articulated to one another and mounted in mobile fashion on a frame in such a manner as to be able to form therebetween a variable angle.

More specifically, the bed according to the invention as herein claimed essentially comprises: a bed frame including a cradle integral thereto; a mattress-holder including a back-rest and a separate seat-rest; a carrier mounted on the cradle for rocking motion therealong; means mounting the back-rest on the carrier for rotation about an axis transverse of the back-rest intermediate its ends; means mounting the seat-rest at one end for rotation about an axis transverse of the seat-rest and further means mounting the other end of the seat rest on the frame for rotation about a further axis transverse of the seat-rest. There are further provided means to cause rocking of the carrier on the cradle and means articulating adjacent ends of the back and seat-rests to one another. Accordingly, when the carrier is rocked, along the cradle, the back-rest and seat-rest are inclined in opposite directions.

A preferred embodiment of the invention follows hereinafter with reference to the appended drawings wherein.

Figure 1:
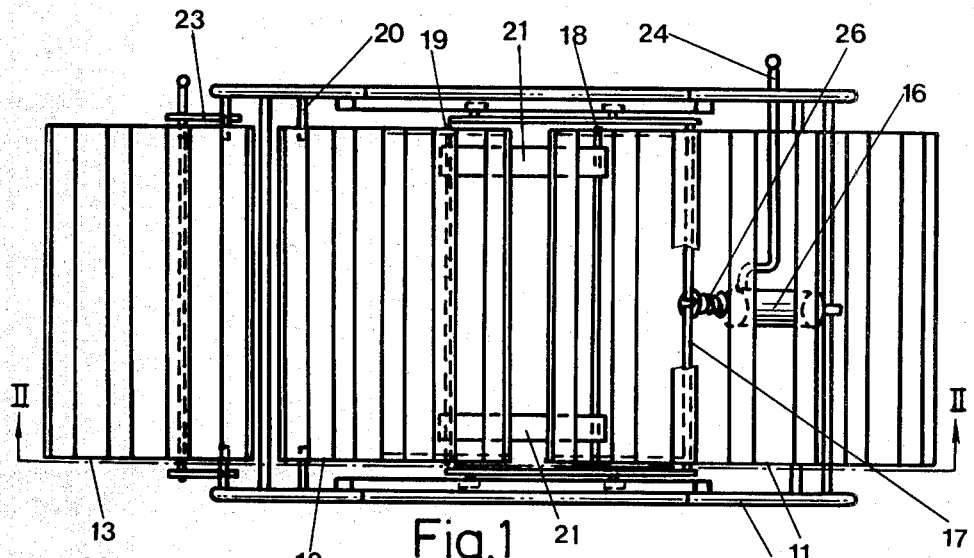
FIG. 1 is a plan view of an articulated bed made according to the invention.
Figure 2:
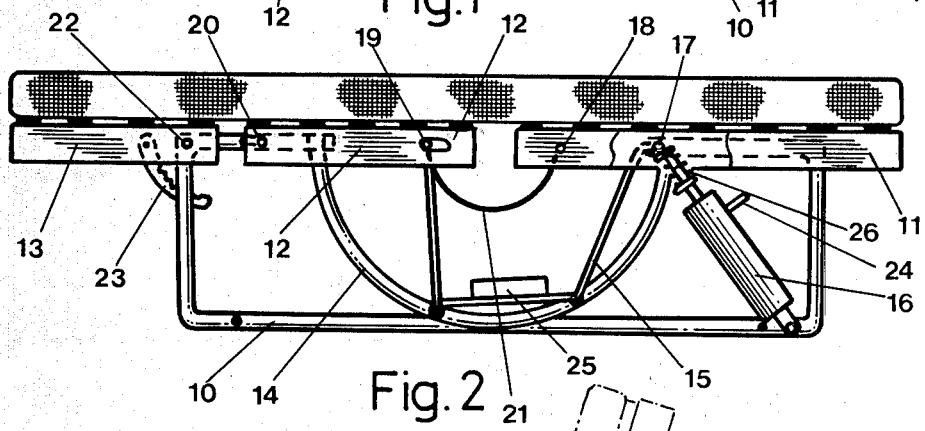
FIG. 2 is a view in cross-section along line II—II of FIG. 1.

The illustrated bed is made up of a tubular frame 10, that can be entirely taken to pieces, of a mattress-holder formed in three articulated parts: a back-rest 11; a seat-rest 12 and a leg-rest 13; of a metal cradle 14 having the shape of an arc of a circle and being integral with the frame 10; of a carrier 15; having in elevation the shape of a U, adapted to roll in the cradle 14, and of a compressed air jack 16, connected at one end to a transverse axle 17 of the carrier 15 and, at the other end, to a base of the frame 10.

The back-rest 11 is mounted for rotation about the axle 17 whereas the seat-rest 12 is mounted for rotation, on the one hand, about a transverse axle 19 of the carrier 15 and, on the other hand, about a transverse axle 20 of the frame 10. The back-rest 11 and the seat-rest 12 are, besides, elastically joined by two spring blades 21 fixed, on the one hand, to the axle 19 and, on the other hand, to a transverse axle 18 of the back-rest 11.

As to the leg-rest 13, it is pivoted on an axle 22 of the frame 10 and it is supported by a device comprising two toothed sectors 23 for adjusting its inclination.

The bed also has a device, operable by a handle 24, for locking the jack 16 to hold the carrier 15 in selected position. An additional load 25 is mounted on the base of the carrier 15 and a coil spring 26 is mounted around the piston rod of jack 16. This rod is made of telescopic parts and the spring 16 extends between the axle 17 and a shoulder provided on one of the telescopic parts thus resiliently joining the piston of the jack 16 and the axle 17.

When the bed is not occupied and the jack 16 is actuated, the carrier 15 is subjected to two couples, opposing one another, respectively created by the bed's own weight together with the weight of the additional load 25 (resultant $P_2$) and by the force F of the jack 16.

The points of application and the strength of forces F and $P_2$ are selected such that the mattress-holder is practically in a state of stable balance for all angular positions of the carrier 15. In fact, the back-rest 11 has a slight tendency to get upright.

When someone lies over the bed, the point of application of his weight $P_1$ generally extends vertically through the pivoting center of the carrier 15 in such a way that the state of stable equilibrium is practically not changed.

Figure 3:
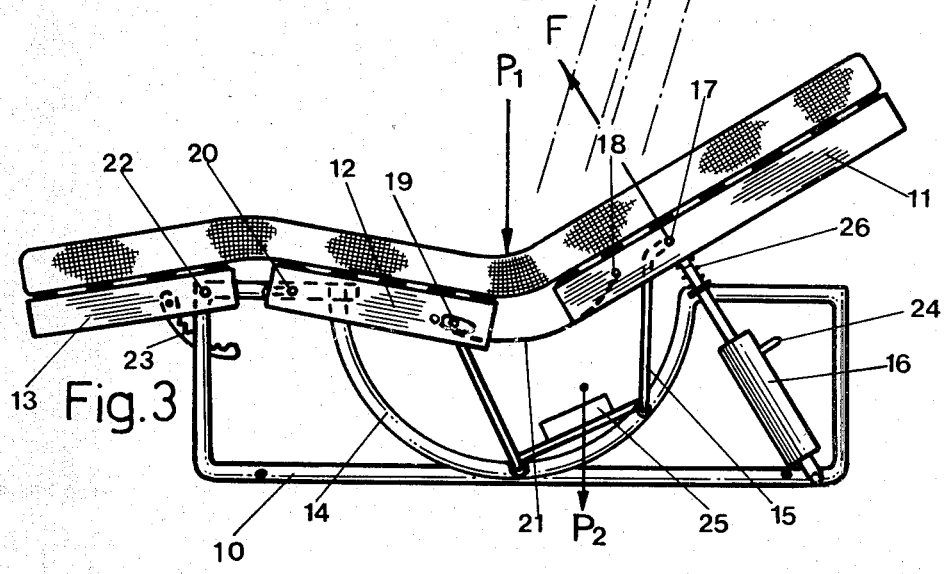
FIG. 3 is a view similar to that of FIG. 2 but illustrating the bed in a second position.

Under these conditions, the user may progressively incline the back-rest 11 up to the limit position illustrated by broken lines in FIG. 3, and then block it in the selected position by acting on the handle 24.

In order to bring the back-rest to horizontal position, it is sufficient for him to move slightly back, that is towards the head of the bed in such a manner as to create, by movement of his center of gravity, a couple opposed to that created by the force F.

Tests have shown that a jack delivering a trust of from 15 to 20 kg is sufficient to provide ideal operation of the bed.

The purpose of the spring 26 is to allow the user to apply a slight rocking motion to the back-rest 11, in the manner of a rocking chair, once the jack is locked. This rocking motion favorizes relaxation when the bed is used as an arm chair.

The invention is obviously not restricted to the embodiment illustrated and described above. Particularly, the load 25 could be replaced by a spring system and the spring 26 by a more elaborate resilient device provided with means allowing to adjust the amplitude of rocking motion as a function of the weight of the user.

It will be noted that the distance separating the back-rest 11 and the seat-rest 12 increases with the angle made therebetween so that, whatever be the value of this angle, the mattress does not make any creases in that area. This represents an important advantage from a medical point of view in the case of hospital beds as it thus removes one of the main causes of bedsores.

It will finally be noted that the bed described above does not require the use of any electric motors which makes it autonomous and does not require any energy.

The embodiments of the invention in which an exclusive property or privilege is claimed are defined as follows:

1. Articulated bed comprising: a bed frame including a cradle integral thereto; a mattress-holder including a back-rest and a separate seat-rest; a carrier and means mounting said carrier on said cradle for rocking motion of said carrier along said cradle; means mounting said back-rest on said carrier for rotation about an axis transverse of said back-rest intermediate the ends thereof; means mounting one end of said seat-rest on said carrier for rotation about an axis transverse of said seat-rest and further means mounting the other end of said seat-rest on said frame for rotation about a further axis transverse of said seat-rest; means to cause rocking of said carrier on said cradle, and means articulating adjacent ends of said back and seat-rests to one another, whereby when said carrier is rocked, along said cradle, said back-rest and seat-rest are inclined in opposite directions.

2. An articulated bed as claimed in claim 1, wherein said cradle has the shape of an arc of a circle.

3. An articulated bed as claimed in claim 2, wherein said carrier is generally U-shaped in side elevation, having two legs; said means mounting said back and seat-rests on said carrier including articulated means at the free ends of said legs whereby when said carrier moves along said arcuate cradle, said articulated means and respective rests are displaced vertically in opposite directions.

4. An articulated bed as claimed in claim 1, including force developing means capable of creating forces acting on said carrier and opposing one another such that said back and seat-rests are substantially in stable equilibrium in any relative position of said rests.

5. An articulated bed as claimed in claim 4, wherein said force developing means comprises said means causing rocking of said carrier.

6. An articulated bed as claimed in claim 5, wherein said means causing rocking of said carrier is a pneumatic jack connected at one end to said frame and, at the other end, to said means mounting said back-rest on said carrier.

7. An articulated bed as claimed in claim 4, including means locking said means causing rocking of said carrier to stabilize the said rests in a selected relative position of said rests.

8. An articulated bed as claimed in claim 7, comprising resilient means disposed between said carrier and said locking means.

9. An articulated bed as claimed in claim 8, wherein said resilient means is adjustable.

* * * * *